US011359441B2

(12) United States Patent
Zhang et al.

(10) Patent No.: US 11,359,441 B2
(45) Date of Patent: Jun. 14, 2022

(54) WET CONNECTOR FOR TRIDENT RIGLESS ELECTRICAL SUBMERSIBLE PUMP (ESP) TECHNOLOGY

(71) Applicant: VERTECHS NOVA TECHNOLOGY CO., LTD., Chengdu (CN)

(72) Inventors: Qiang Zhang, Chengdu (CN); Mengpan Zhao, Chengdu (CN); Qijun Zeng, Chengdu (CN)

(73) Assignee: VERTECHS NOVA TECHNOLOGY CO., LTD., Chengdu (CN)

( * ) Notice: Subject to any disclaimer, the term of this patent is extended or adjusted under 35 U.S.C. 154(b) by 0 days.

(21) Appl. No.: 17/420,394

(22) PCT Filed: Apr. 20, 2020

(86) PCT No.: PCT/CN2020/085592
§ 371 (c)(1),
(2) Date: Jul. 2, 2021

(87) PCT Pub. No.: WO2021/212264
PCT Pub. Date: Oct. 28, 2021

(65) Prior Publication Data

US 2022/0056768 A1 Feb. 24, 2022

(51) Int. Cl.
*E21B 17/02* (2006.01)
*H01R 13/17* (2006.01)
*H01R 13/52* (2006.01)

(52) U.S. Cl.
CPC ..... *E21B 17/0285* (2020.05); *H01R 13/17* (2013.01); *H01R 13/521* (2013.01)

(58) Field of Classification Search
CPC .... H01R 13/523; H01R 13/521; H01R 13/17; E21B 17/0285
(Continued)

(56) References Cited

U.S. PATENT DOCUMENTS 2,620,029 A * 12/1952 Turechek ..... E21B 43/116 439/426
3,649,949 A * 3/1972 McCarthy ..... E21B 17/028 439/194
(Continued)

FOREIGN PATENT DOCUMENTS

CN 204858187 U 12/2015
GB 2227277 A 7/1990

*Primary Examiner* — Neil Abrams
(74) *Attorney, Agent, or Firm* — Bayramoglu Law Offices LLC

(57) ABSTRACT

A wet connector for a downhole tool string includes an insulating material body, a conductive core and an insulating piston. The insulating material body is provided with a first chamber, and the first chamber is filled with insulating oil. A conductive core chamber of the conductive core is communicated with the first chamber. The insulating piston is hermetically connected to a first opening through a first sealing lip. When a male connector abuts against the insulating piston and moves toward the bottom of the conductive core chamber, the male connector is in contact with and electrically connected to the conductive core chamber and causes oil to flow from the conductive core chamber so that the insulating oil in the first chamber is compressed and a pressure of the insulating oil in the first chamber is enabled to be greater than a pressure of well fluid outside the wet connector.

19 Claims, 6 Drawing Sheets

(58) Field of Classification Search
USPC ..... 439/201
See application file for complete search history.

(56) References Cited

U.S. PATENT DOCUMENTS 3,753,206 A * 8/1973 Busuttil ..... E21B 17/028 439/669
3,845,450 A * 10/1974 Cole ..... H01R 13/523 439/204
3,976,347 A * 8/1976 Cooke, Sr. ..... E21B 17/028 439/350
4,117,287 A * 9/1978 Walker ..... E21B 33/0385 200/82 R
4,142,770 A * 3/1979 Butler, Jr. ..... H01R 13/523 439/140
4,174,875 A * 11/1979 Wilson ..... H01R 13/523 439/700
4,445,734 A * 5/1984 Cunningham ..... H01R 13/523 439/194
4,490,073 A * 12/1984 Lawson ..... F16L 39/00 166/344
4,706,744 A 11/1987 Smith et al.
4,825,946 A * 5/1989 Schnatzmeyer ..... E21B 47/06 166/66
4,859,196 A * 8/1989 Durando ..... H01R 13/523 439/519
4,909,320 A * 3/1990 Hebert ..... E21B 29/12 439/190
4,909,747 A * 3/1990 Daubigny ..... H01R 13/523 439/140
5,007,852 A * 4/1991 Dean ..... H01R 13/523 439/201
5,052,941 A * 10/1991 Hernandez-Marti ..... E21B 33/0407 340/854.8
5,140,659 A * 8/1992 Minds ..... F41G 7/32 244/3.16
5,171,158 A * 12/1992 Cairns ..... H01R 13/523 439/190
5,203,805 A * 4/1993 Cairns ..... H01R 13/523 439/271
5,645,442 A * 7/1997 Cairns ..... H01R 13/523 439/271
5,738,535 A * 4/1998 Cairns ..... H01R 13/523 439/138
5,772,457 A * 6/1998 Cairns ..... H01R 13/523 439/201
6,776,636 B1 * 8/2004 Cameron ..... E21B 17/028 439/191
7,086,880 B2 * 8/2006 Uchida ..... H01R 13/4538 439/141
7,500,859 B2 * 3/2009 Dubranna ..... H01R 13/523 439/140
7,543,659 B2 * 6/2009 Partouche ..... E21B 17/02 166/242.6
7,695,301 B2 * 4/2010 Mudge, III ..... H01R 13/533 439/732
8,485,837 B2 * 7/2013 Head ..... 439/190
8,702,439 B1 * 4/2014 Paulsel ..... H01R 13/523 439/271
9,225,114 B2 * 12/2015 Sinclair ..... H01R 13/6276
9,263,824 B2 * 2/2016 Cairns ..... H01R 24/38
9,466,916 B2 * 10/2016 Li ..... H01R 13/4538
2002/0123256 A1 * 9/2002 Brickett ..... H01R 13/533 439/140
2022/0056768 A1 * 2/2022 Zhang ..... H01R 13/17

* cited by examiner

WET CONNECTOR FOR TRIDENT RIGLESS ELECTRICAL SUBMERSIBLE PUMP (ESP) TECHNOLOGY

CROSS REFERENCE TO THE RELATED APPLICATIONS

This application is the national phase entry of International Application No. PCT/CN2020/085592, filed on Apr. 20, 2020, the entire contents of which are incorporated herein by reference.

TECHNICAL FIELD

The present invention relates to the field of petroleum downhole operation, in particular to a wet connector for a downhole tool string, and the downhole tool string.

BACKGROUND

Cable and other tools are commonly used in petroleum downhole operation. The wellbore generally has a small inner diameter, but the wet connector commonly used usually has a large overall size, which makes it inconvenient for electrical connections and other downhole operations.

SUMMARY

A technical problem to be solved by the present invention is to provide a wet connector for a downhole tool string. The present invention keeps the conductor size and reduces the radial overall size of the wet connector.

In order to solve the above technical problem, the present invention adopts the following technical solutions. A wet connector for a downhole tool string includes an insulating material body, a conductive core, and an insulating piston.

The insulating material body is provided with a first chamber, and the first chamber is filled with insulating oil.

One end of the conductive core is electrically connected to the outside and is hermetically connected to one end of the first chamber. The other end of the conductive core is provided with a conductive core chamber electrically connected to a male connector, and is adjacent to the inner surface of the other end of the first chamber. The conductive core chamber is communicated with the first chamber. The other end of the first chamber is provided with a first opening matched with the inner diameter of the conductive core chamber.

The insulating piston is hermetically connected to the first opening through a first sealing lip. The insulating piston is connected to the conductive core chamber through an elastic member. When the male connector abuts against the insulating piston and moves toward the bottom of the conductive core chamber, the male connector is in contact with and electrically connected to the conductive core chamber.

The working principle and advantages of the present invention are as follows. The conductive core is arranged in the first chamber in the insulating material body, and the first chamber is fully filled with insulating oil. In this way, the whole structure is manageable and compact in size. Moreover, the insulating oil and the insulating material body forms a two-layer insulating protection to achieve a desirable downhole insulation effect. In addition, the insulating piston is hermetically connected to the first opening through the first sealing lip. When the male connector abuts against the insulating piston and moves toward the bottom of the conductive core chamber, the male connector is in contact with and electrically connected to the conductive core chamber, so that the insulating oil in the first chamber is compressed, and the pressure of the insulating oil in the first chamber is enabled to be greater than the pressure of well fluid outside the wet connector. In this way, the well fluid is prevented from entering the first chamber, such that the wet connector maintains a desirable insulation effect.

On the basis of the above technical solution, the present invention may be further improved.

As an improved solution, the wet connector further includes a second chamber. The second chamber is made of an insulating material and is filled with the insulating oil. The second chamber is provided with a second opening. The second opening is hermetically connected to the insulating piston through a second sealing lip. An insulating elastic bag is arranged between the first chamber and the second chamber. When the insulating oil in the first chamber is compressed, the insulating elastic bag moves toward the second chamber.

The advantages of the above improved solution are as follows. When the male connector abuts against the insulating piston and moves toward the bottom of the conductive core chamber, the male connector is in contact with and electrically connected to the conductive core chamber, so that the insulating oil in the first chamber is compressed, and the insulating elastic bag moves toward the second chamber under the pressure of the insulating oil in the first chamber. As a result, the insulating oil in the second chamber is compressed, and the pressure of the insulating oil in the second chamber is enabled to be greater than the pressure of well fluid outside the wet connector. In this way, the well fluid is prevented from entering the second chamber, so as to form a secondary insulating protection, thereby further improving the insulation effect of the wet connector. In addition, the fluctuation of the pressure is fed back timely due to the balanced design of the insulating elastic bag, which improves the insulation reliability of the wet connector.

On the basis of the above technical solution, the present invention may be further improved.

As an improved solution, the wet connector further includes a third chamber. The insulating elastic bag is an insulating elastic capsule. The insulating elastic capsule is arranged between the third chamber and the first chamber. The first chamber is communicated with the insulating elastic capsule. The outer wall of the insulating elastic capsule is located in the third chamber. The third chamber is communicated with the second chamber.

The advantages of the above improved solution are as follows. The third chamber is additionally arranged, and the insulating elastic bag is arranged between the third chamber and the first chamber, so that the area of the insulating elastic bag is increased, which improves the timeliness for feeding back the fluctuation of the pressure, and further improves the insulation reliability of the wet connector.

On the basis of the above technical solution, the present invention may be further improved.

As an improved solution, the first chamber and the second chamber are both arranged in the insulating material body, and the third chamber is arranged outside the insulating material body. The wet connector further includes an insulating housing. The insulating housing covers the first chamber, the second chamber and the third chamber. The insulating housing is provided with a third opening matched with the second opening. The second sealing lip is formed at the third opening to be hermetically connected to the insulating piston.

The advantages of the above improved solution are as follows. The insulating housing is arranged to further improve the insulation effect of the whole wet connector. Moreover, the third chamber is arranged outside the insulating material body, so that the volume of the third chamber is increased. In this way, the oil storage capacity of the third chamber is increased, and the insulation effect of the wet connector is improved. In addition, the area of the insulating elastic bag arranged in the third chamber is increased due to the increased volume of the third chamber, which further improves the timeliness for feeding back the fluctuation of the pressure.

On the basis of the above technical solution, the present invention may be further improved.

As an improved solution, the wet connector further includes a metal housing. The metal housing covers the insulating housing. The metal housing is provided with a fourth opening matched with the third opening. The diameter of the fourth opening is larger than the diameter of the third opening.

The advantages of the above improved solution are as follows. The metal housing is used to protect the wet connector from being damaged, and it can also play a role in electromagnetic shielding.

On the basis of the above technical solution, the present invention may be further improved.

As an improved solution, the fourth opening is provided with a tapered guide surface, and the tapered guide surface is matched with the shape of the male connector.

The advantages of the above improved solution are as follows. The tapered guide surface plays a desirable guiding role in the process of inserting the male connector to avoid position deviation.

On the basis of the above technical solution, the present invention may be further improved.

As an improved solution, an end of the insulating piston abutting against the male connector is provided with a positioning groove, and the positioning groove and the male connector are coaxial.

The advantages of the above improved solution are as follows. The positioning groove and the male connector are coaxial to ensure that the male connector is smoothly inserted into the conductive core chamber.

On the basis of the above technical solution, the present invention may be further improved.

As an improved solution, a chamber body of the conductive core chamber is provided with a plurality of through holes, and the through holes are communicated with the first chamber.

The advantages of the above improved solution are as follows. The plurality of through holes in the chamber body of the conductive core chamber are arranged to ensure that the oil pressure in the conductive core chamber is transmitted to the first chamber in time after the male connector is inserted into the conductive core chamber.

On the basis of the above technical solution, the present invention may be further improved.

As an improved solution, the elastic member is a spring.

The advantages of the above improved solution are as follows. The spring is a commonly used elastic member with a desirable elastic deformation and recovery ability.

The present invention further provides a downhole tool string including a wet connector connected to a cable, and the wet connector employs the aforementioned wet connectors.

The advantages of the downhole tool string of the present invention are as follows. The conductive core of the wet connector of the downhole tool string is arranged in the first chamber in the insulating material body, and the first chamber is fully filled with insulating oil. In this way, the whole structure is manageable and compact in size. Moreover, the insulating oil and the insulating material body forms a two-layer insulating protection to achieve a desirable downhole insulation effect. In addition, the insulating piston is hermetically connected to the first opening through the first sealing lip. When the male connector abuts against the insulating piston and moves toward the bottom of the conductive core chamber, the male connector is in contact with and electrically connected to the conductive core chamber, so that the insulating oil in the first chamber is compressed, and the pressure of the insulating oil in the first chamber is enabled to be greater than the pressure of well fluid outside the wet connector. In this way, the well fluid is prevented from entering the first chamber, such that the wet connector maintains a desirable insulation effect, ensuring the reliability of the downhole tool string in operation.

1. insulating material body; 11. first chamber; 12. first opening; 13. internal flow passage; 2. conductive core; 21. conductive core chamber; 20. through hole; 3. insulating piston; 31. first sealing lip; 32. elastic member; 33. positioning groove; 4. second chamber; 41. second opening; 42. second sealing lip; 5. insulating elastic bag; 6. third chamber; 7. insulating housing; 71. third opening; 8. metal housing; 81. fourth opening; 82. tapered guide surface; 9. male connector; 91. conductive plug of the male connector; 92. insulating sleeve; 10. external wire.

DETAILED DESCRIPTION OF THE EMBODIMENTS

The principles and features of the present invention are described below with reference to the drawings. The listed embodiments are only used to explain the present invention, rather than to limit the scope of the present invention.

Figure 1:
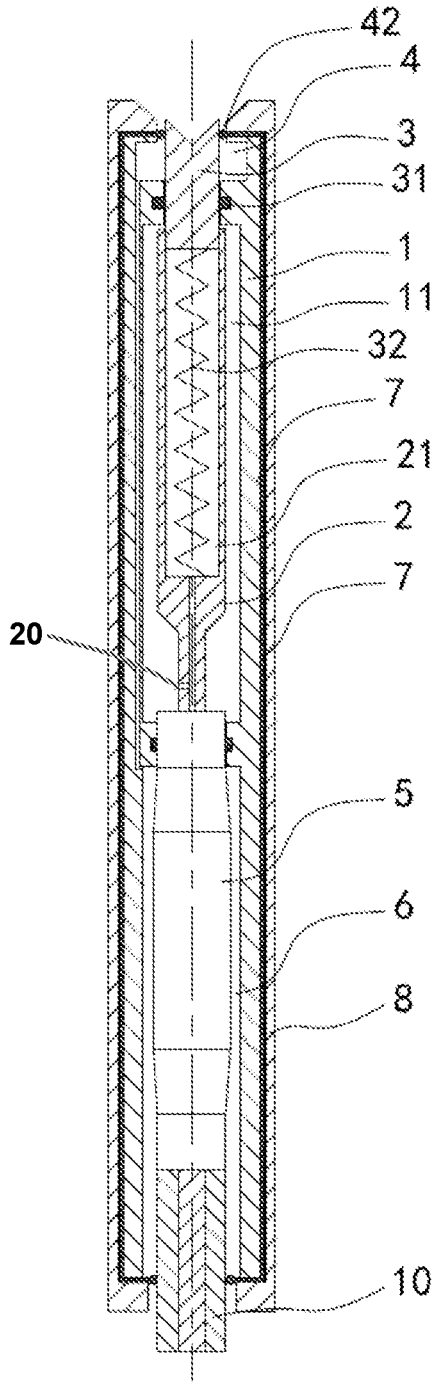
FIG. 1 is a cross-sectional view of a wet connector according to Embodiment 1 of the present invention.
Figure 2:
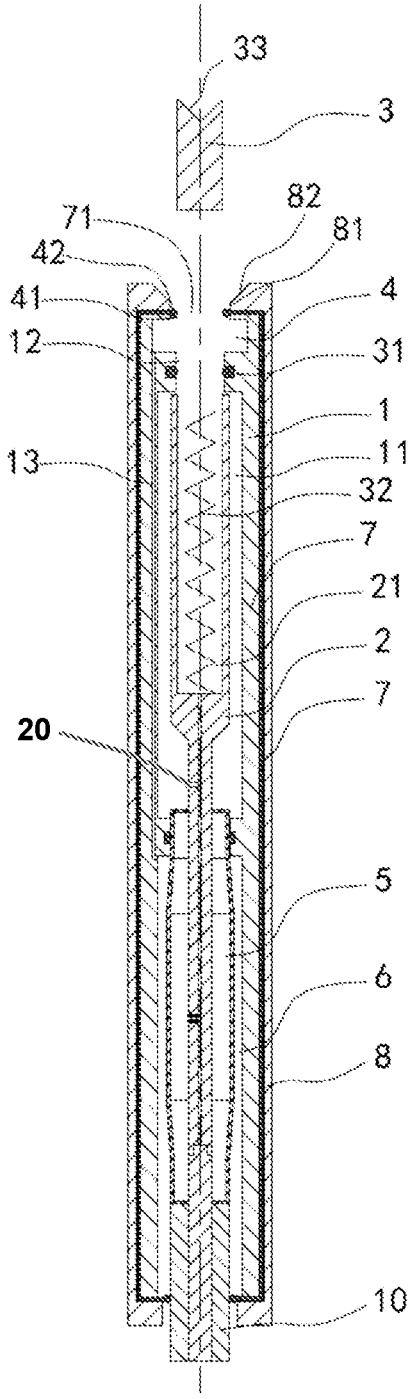
FIG. 2 is a cross-sectional view showing the insulating piston 3 separated from a main body according to Embodiment 1 of the present invention.

FIGS. 1 and 2 show a schematic diagram of the structure of Embodiment 1 of the present invention. A wet connector for a downhole tool string includes the insulating material body 1.

The insulating material body 1 is provided with the first chamber 11, and the first chamber 11 is filled with insulating oil.

The wet connector further includes the second chamber 4. The second chamber 4 is made of an insulating material, and the second chamber 4 is filled with the insulating oil. The second chamber 4 is provided with the second opening 41.

The second opening 41 is hermetically connected to the insulating piston 3 through the second sealing lip 42. The insulating elastic bag 5 is arranged between the first chamber 11 and the second chamber 4. When the insulating oil in the first chamber 11 is compressed, the insulating elastic bag 5 moves toward the second chamber 4.

The wet connector further includes the third chamber 6. The insulating elastic bag 5 is an insulating elastic capsule. The insulating elastic capsule is arranged between the third chamber 6 and the first chamber 11, that is, one end of the insulating elastic capsule is arranged at one end of the first chamber 11, and the other end of the insulating elastic capsule is fixedly connected to one end of the external wire 10. The first chamber 11 is communicated with an inner chamber of the insulating elastic capsule, that is, the conductive core chamber 21 arranged in the first chamber 11 is communicated with the inner chamber of the insulating elastic capsule through a through hole 20. The outer wall of the insulating elastic capsule is located in the third chamber 6. The third chamber 6 is communicated with the second chamber 4.

The first chamber 11, the second chamber 4 and the third chamber 6 are all arranged in the insulating material body 1.

The wet connector further includes the conductive core 2. One end of the conductive core 2 is electrically connected to the outside, that is, one end of the conductive core 2 is connected to the external wire 10, and is hermetically connected to one end of the first chamber 11. The other end of the conductive core 2 is provided with the conductive core chamber 21 electrically connected to the male connector 9, and is adjacent to the inner surface of the other end of the first chamber 11. The conductive core chamber 21 is communicated with the first chamber 11. The other end of the first chamber 11 is provided with the first opening 12 matched with the inner diameter of the conductive core chamber 21.

The wet connector further includes the insulating piston 3. The insulating piston 3 is hermetically connected to the first opening 12 through the first sealing lip 31. The insulating piston 3 is connected to the conductive core chamber 21 through the elastic member 32. When the male connector 9 abuts against the insulating piston 3 and moves toward the bottom of the conductive core chamber 21, the male connector 9 is in contact with and electrically connected to the conductive core chamber 21. Moreover, an end of the insulating piston 3 abutting against the male connector 9 is provided with the positioning groove 33, and the positioning groove 33 and the male connector 9 are coaxial.

The wet connector further includes the insulating housing 7. The insulating housing 7 covers the first chamber 11, the second chamber 4 and the third chamber 6. The insulating housing 7 is provided with the third opening 71 matched with the second opening 41. The third opening 71 is hermetically connected to the insulating piston 3. In the present embodiment, the insulating housing 7 is a rubber sleeve. The rubber sleeve forms the second sealing lip 42 at the third opening 71 to be hermetically connected to the insulating piston 3.

In the present embodiment, the wet connector further includes the metal housing 8. The metal housing 8 covers the insulating housing 7. The metal housing 8 is provided with the fourth opening 81 matched with the third opening 71. The diameter of the fourth opening 81 is larger than the diameter of the third opening 71. Moreover, the fourth opening 81 is provided with the tapered guide surface 82. The tapered guide surface 82 is matched with the shape of the male connector 9.

The working principle of the present invention is as follows. When the male connector 9 abuts against the insulating piston 3 and moves toward the bottom of the conductive core chamber 21, the male connector 9 is in contact with and electrically connected to the conductive core chamber 21, so that the insulating oil in the first chamber 11 is compressed, and the insulating elastic bag 5 moves toward the third chamber 6 under the pressure of the insulating oil in the first chamber 11. Meanwhile, the insulating oil in the third chamber 6 flows to the second chamber 4 through the internal flow passage 13, so that the insulating oil in the second chamber 4 is compressed, and the pressure of the insulating oil in the second chamber 4 is enabled to be greater than the pressure of well fluid outside the wet connector. In this way, the well fluid is prevented from entering the second chamber 4, so as to form a secondary insulating protection, thereby further improving the insulation effect of the wet connector. In addition, the fluctuation of the pressure is fed back timely due to the balanced design of the insulating elastic bag 5, which improves the insulation reliability of the wet connector.

In a specific implementation, only one chamber may be arranged, that is, the conductive core 2 is arranged in the first chamber 11 in the insulating material body 1, and the first chamber 11 is fully filled with insulating oil. In this way, the whole structure is manageable and compact in size. Moreover, the insulating oil and the insulating material body 1 forms a two-layer insulating protection to achieve a desirable downhole insulation effect. In addition, the insulating piston 3 is hermetically connected to the first opening 12 through the first sealing lip 31. When the male connector 9 abuts against the insulating piston 3 and moves toward the bottom of the conductive core chamber 21, the male connector 9 is in contact with and electrically connected to the conductive core chamber 21, so that the insulating oil in the first chamber 11 is compressed, and the pressure of the insulating oil in the first chamber 11 is enabled to be greater than the pressure of well fluid outside the wet connector. In this way, the well fluid is prevented from entering the first chamber 11, such that the wet connector maintains a desirable insulation effect.

In a specific embodiment, two chambers may also be directly arranged. The first chamber 11 and the second chamber 4 are both located in the insulating material body 1, and the second chamber 4 is communicated with the first chamber 11 through an internal flow passage. Moreover, the insulating elastic bag 5 is arranged between the first chamber 11 and the second chamber 4. When the insulating oil in the first chamber 11 is compressed, the insulating elastic bag 5 moves toward the second chamber 4.

When the male connector 9 abuts against the insulating piston 3 and moves toward the bottom of the conductive core chamber 21, the male connector 9 is in contact with and electrically connected to the conductive core chamber 21, so that the insulating oil in the first chamber 11 is compressed, and the insulating elastic bag 5 moves toward the second chamber 4 under the pressure of the insulating oil in the first chamber 11. The insulating oil in the first chamber 11 flows to the second chamber 4 through an internal flow passage, so that the insulating oil in the second chamber 4 is compressed, and the pressure of the insulating oil in the second chamber 4 is enabled to be greater than the pressure of well fluid outside the wet connector. In this way, the well fluid is prevented from entering the second chamber 4, so as to form a secondary insulating protection, thereby further improving the insulation effect of the wet connector. In addition, the fluctuation of the pressure is fed back timely due to the balanced design of the insulating elastic bag 5, which improves the insulation reliability of the wet connector.

Figure 3:
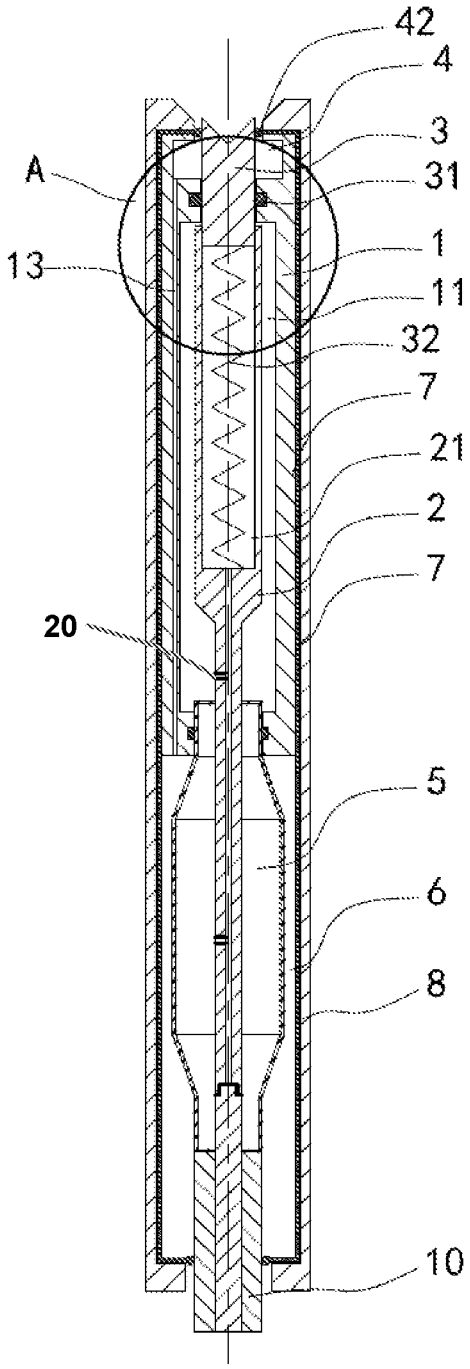
FIG. 3 is a cross-sectional view of the wet connector according to Embodiment 2 of the present invention.
Figure 4:
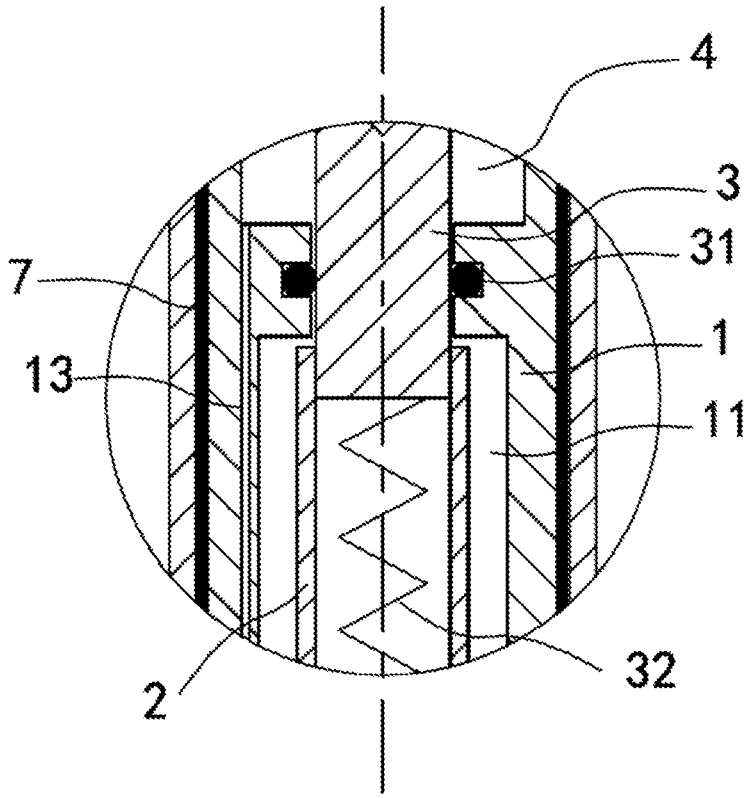
FIG. 4 is an enlarged view of the portion A circled in FIG. 3.

FIGS. 2 and 3 show a schematic diagram of the structure of Embodiment 2 of the present invention. Different from Embodiment 1, in the present embodiment, the first chamber 11 and the second chamber 4 are both arranged in the insulating material body 1, while the third chamber 6 is arranged outside the insulating material body 1.

The third chamber 6 is arranged outside the insulating material body 1, so that the volume of the third chamber 6 is increased. In this way, the oil storage capacity of the third chamber 6 is increased, and the insulation effect of the wet connector is improved. In addition, the area of the insulating elastic bag 5 arranged in the third chamber 6 is increased due to the increased volume of the third chamber 6, which further improves the timeliness for feeding back the fluctuation of the pressure.

In the above two embodiments, the elastic member 32 is a spring. In specific implementations, other elastic members may also be employed to meet different requirements.

In the above two embodiments, the chamber body of the conductive core chamber 21 is provided with a plurality of through holes 20, and the through holes 20 are communicated with the first chamber 11. The plurality of through holes 20 in the chamber body of the conductive core chamber 21 are arranged to ensure that the oil pressure in the conductive core chamber 21 is transmitted to the first chamber 11 in time after the male connector 9 is inserted into the conductive core chamber 21.

Figure 5:
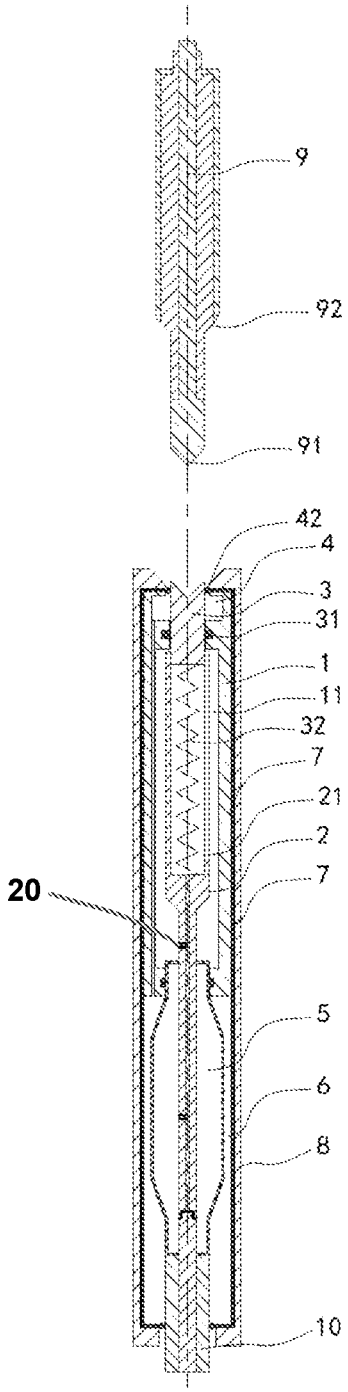
FIG. 5 is a cross-sectional view showing the wet connector separated from the male connector 9 according to Embodiment 2 of the present invention.
Figure 6:
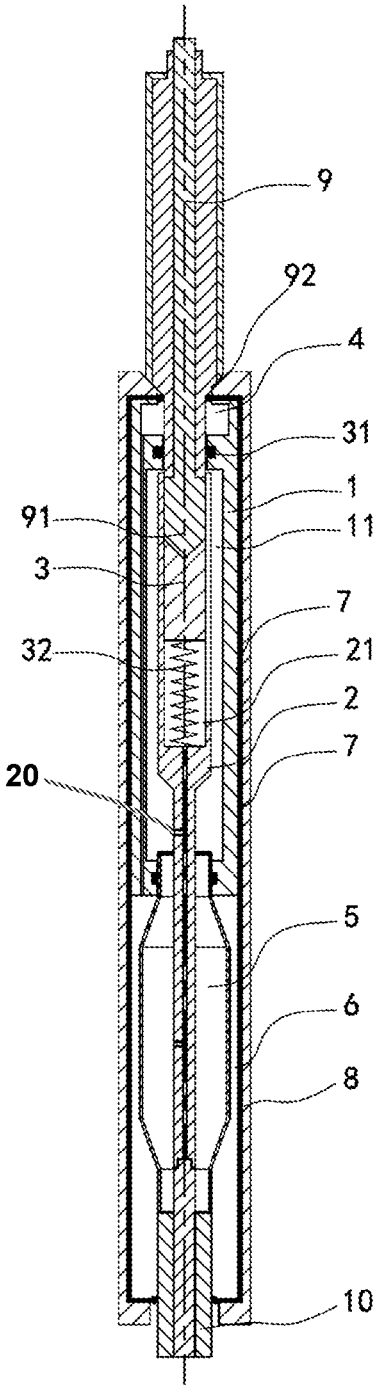
FIG. 6 is a cross-sectional view showing the wet connector fitted with the male connector 9 according to Embodiment 2 of the present invention.

FIGS. 5 and 6 show a schematic diagram of cooperation between the wet connector of Embodiment 2 of the present invention and the male connector 9. The male connector 9 further includes the conductive plug 91 of the male connector and the insulating sleeve 92. The conductive plug 91 of the male connector is tapered, and the positioning groove 33 of the wet connector is correspondingly provided as a tapered groove. When the male connector 9 is inserted into the wet connector of Embodiment 2 of the present invention, the conductive plug 91 of the male connector first enters the fourth opening 81 of the metal housing 8 through the tapered guide surface 82, and then contacts with the positioning groove 33. Since the positioning groove 33 and the male connector 9 are coaxial, that is, the positioning groove 33 and the conductive plug 91 of the male connector are coaxial, it is ensured that the outer diameter of the conductive plug 91 of the male connector and the outer diameter of the insulating piston 3 are coplanar. The conductive plug 91 of the male connector pushes the insulating piston 3 to move toward the conductive core chamber 21. When a structure on the male connector 9 matched with the tapered guide surface 82 at the fourth opening 81 is in contact with and fitted with the tapered guide surface 82, the male connector 9 stops pushing the insulating piston 3, and the conductive plug 91 of the male connector completely enters and is electrically connected to the conductive core chamber 21. At this time, the part of the insulating sleeve 92 of the male connector 9 located in the wet connector is hermetically in contact with the first sealing lip 31 and the second sealing lip 42 to form a double-layer sealing structure.

Meanwhile, since the insulating oil in the first chamber 11 is compressed, the insulating elastic bag 5 moves toward the third chamber 6 under the pressure of the insulating oil in the first chamber 11. The insulating oil in the third chamber 6 flows to the second chamber 4 through the internal flow passage 13, so that the insulating oil in the second chamber 4 is compressed, and the pressure of the insulating oil in the second chamber 4 is enabled to be greater than the pressure of well fluid outside the wet connector. In this way, the well fluid is prevented from entering the second chamber 4, so as to form a secondary insulating protection, thereby further improving the insulation effect of the wet connector.

An embodiment of the present invention further provides a downhole tool string including a wet connector connected to a cable, and the wet connector employs the aforementioned wet connectors.

The working principle and advantages of the downhole tool string of the present invention are as follows. The conductive core 2 of the wet connector of the downhole tool string is arranged in the first chamber 11 in the insulating material body 1, and the first chamber 11 is fully filled with insulating oil. In this way, the whole structure is manageable and compact in size. Moreover, the insulating oil and the insulating material body 1 forms a two-layer insulating protection to achieve a desirable downhole insulation effect. In addition, the insulating piston 3 is hermetically connected to the first opening 12 through the first sealing lip 31. When the male connector 9 abuts against the insulating piston 3 and moves toward the bottom of the conductive core chamber 21, the male connector 9 is in contact with and electrically connected to the conductive core chamber 21, so that the insulating oil in the first chamber 11 is compressed, and the pressure of the insulating oil in the first chamber 11 is enabled to be greater than the pressure of well fluid outside the wet connector. In this way, the well fluid is prevented from entering the first chamber 11, such that the wet connector maintains a desirable insulation effect, ensuring the reliability of the downhole tool string in operation.

The above merely describes preferred embodiments of the present invention, which are not intended to limit the present invention. Any improvements, equivalent replacements and improvements made within the spirit and principle of the present invention shall fall within the scope of protection of the present invention.

What is claimed is:

1. A wet connector for a downhole tool string, comprising an insulating material body, wherein the insulating material body is provided with a first chamber, and the first chamber is filled with insulating oil;

a conductive core, wherein a first end of the conductive core is electrically connected to an external wire, and the first end of the conductive core is hermetically connected to a first end of the first chamber; a second end of the conductive core is provided with a conductive core chamber electrically connected to a male connector, and the second end of the conductive core is adjacent to an inner surface of a second end of the first chamber; the conductive core chamber is communicated with the first chamber; the second end of the first chamber is provided with a first opening matched with an inner diameter of the conductive core chamber;

an insulating piston, wherein the insulating piston is hermetically connected to the first opening through a first sealing lip; the insulating piston is connected to the conductive core chamber through an elastic member; when the male connector abuts against the insulating piston and the male connector moves toward a bottom of the conductive core chamber, the male connector is in contact with and electrically connected to the conductive core chamber; and a second chamber, wherein the second chamber is made of an insulating material, and the second chamber is filled with the insulating oil; the second chamber is provided with a second opening; the second opening is hermetically connected to the insulating piston through a second sealing lip; an insulating elastic bag is arranged between the first chamber and the second chamber; when the insulating oil in the first chamber is compressed, the insulating elastic bag moves toward the second chamber.

2. The wet connector of claim 1, further comprising:

a third chamber, wherein the insulating elastic bag is an insulating elastic capsule; the insulating elastic capsule is arranged between the third chamber and the first chamber; the first chamber is communicated with the insulating elastic capsule; an outer wall of the insulating elastic capsule is located in the third chamber; the third chamber is communicated with the second chamber.

3. The wet connector of claim 2, further comprising:

an insulating housing, wherein the first chamber and the second chamber are arranged in the insulating material body; the insulating housing covers the first chamber, the second chamber and the third chamber; the insulating housing is provided with a third opening matched with the second opening; the second sealing lip is formed at the third opening to be hermetically connected to the insulating piston.

4. The wet connector of claim 3, further comprising:

a metal housing, wherein the metal housing covers the insulating housing; the metal housing is provided with a fourth opening matched with the third opening; a diameter of the fourth opening is larger than a diameter of the third opening.

5. The wet connector of claim 4, wherein the fourth opening is provided with a tapered guide surface, and the tapered guide surface is matched with a shape of the male connector.

6. The wet connector of claim 1, wherein an end of the insulating piston is provided with a positioning groove, and the positioning groove and the male connector are coaxial, wherein the end of the insulating piston abuts against the male connector.

7. The wet connector of claim 1, wherein a chamber body of the conductive core chamber is provided with a through hole communicated with the first chamber.

8. The wet connector of claim 1, wherein the elastic member is a spring.

9. A downhole tool string, comprising the wet connector of claim 1, wherein the wet connector is connected to a cable.

10. The wet connector of claim 1, wherein an end of the insulating piston is provided with a positioning groove, and the positioning groove and the male connector are coaxial, wherein the end of the insulating piston abuts against the male connector.

11. The wet connector of claim 2, wherein an end of the insulating piston is provided with a positioning groove, and the positioning groove and the male connector are coaxial, wherein the end of the insulating piston abuts against the male connector.

12. The wet connector of claim 3, wherein an end of the insulating piston is provided with a positioning groove, and the positioning groove and the male connector are coaxial, wherein the end of the insulating piston abuts against the male connector.

13. The wet connector of claim 4, wherein an end of the insulating piston is provided with a positioning groove, and the positioning groove and the male connector are coaxial, wherein the end of the insulating piston abuts against the male connector.

14. The wet connector of claim 5, wherein an end of the insulating piston is provided with a positioning groove, and the positioning groove and the male connector are coaxial, wherein the end of the insulating piston abuts against the male connector.

15. The wet connector of claim 6, wherein a chamber body of the conductive core chamber is provided with a through hole communicated with the first chamber.

16. The wet connector of claim 2, wherein a chamber body of the conductive core chamber is provided with a through hole communicated with the first chamber.

17. The wet connector of claim 3, wherein a chamber body of the conductive core chamber is provided with a through hole communicated with the first chamber.

18. The wet connector of claim 4, wherein a chamber body of the conductive core chamber is provided with a through hole communicated with the first chamber.

19. The wet connector of claim 5, wherein a chamber body of the conductive core chamber is provided with a through hole communicated with the first chamber.

* * * * *